US005513778A

United States Patent [19]

Cardia et al.

[11] Patent Number: 5,513,778

[45] Date of Patent: May 7, 1996

[54] DISPENSER FOR A VISCOUS FLUID PRODUCT OPERATED BY MANUAL PRESSURE ON A BOTTOM END THEREOF, IN PARTICULAR FOR COSMETIC OR PHARMACEUTICAL USE

[76] Inventors: Ennio Cardia; Anna Maria Ballarati, both of Via Durazzo n.18, 00195 Roma, Italy

[21] Appl. No.: 277,628

[22] Filed: Jul. 20, 1994

[30] Foreign Application Priority Data

Jul. 22, 1993 [IT] Italy ..... RM93A0490

[51] Int. Cl.[6] ..... B65D 88/60

[52] U.S. Cl. ..... 222/327; 222/386

[58] Field of Search ..... 222/327, 386

[56] References Cited

U.S. PATENT DOCUMENTS

| | | | |
|---|---|---|---|
| 878,622 | 2/1908 | Ferner | 222/386 |
| 1,265,533 | 5/1918 | Searle et al. | 222/386 |
| 1,318,928 | 10/1919 | Shields | 222/327 |
| 2,076,549 | 4/1937 | Conner | 215/6 |
| 4,984,718 | 1/1991 | Cardia | 222/390 |
| 5,000,600 | 3/1991 | Cardia et al. | 222/390 X |
| 5,295,615 | 3/1994 | Gentile | 222/327 |

FOREIGN PATENT DOCUMENTS

| | | | |
|---|---|---|---|
| 788726 | 1/1973 | Belgium . | |
| 0256923 | 2/1988 | European Pat. Off. . | |
| 0434326 | 6/1991 | European Pat. Off. . | |
| 0457452 | 11/1991 | European Pat. Off. . | |
| 795561 | 3/1936 | France | 222/386 |
| 799138 | 6/1936 | France | 222/386 |
| 800605 | 7/1936 | France . | |
| 800607 | 7/1936 | France . | |
| 4101994 | 7/1992 | Germany . | |
| 236015 | 7/1925 | United Kingdom | 222/386 |
| 463316 | 3/1937 | United Kingdom | 222/386 |
| 467410 | 6/1937 | United Kingdom | 222/386 |
| 514787 | 11/1939 | United Kingdom | 222/386 |
| 718172 | 4/1951 | United Kingdom . | |

*Primary Examiner*—Andres Kashnikow
*Assistant Examiner*—Kenneth Bomberg
*Attorney, Agent, or Firm*—Browdy and Neimark

[57] ABSTRACT

A dispenser of products such as creams and the like for cosmetic or pharmaceutical use having a lid which closes on to a first annular abutment of a tubular outer body. The outer body having an open bottom end with an aperture wherethrough a recipient containing the product is inserted and removed and a top end which is open. The recipient having an open bottom end housing a piston which when manually pressed in an axial direction, without rotation, presses the product in the recipient towards a dispensing aperture provided in a closed end of the recipient such as to dispense a continuous quantity and not a prefixed dose of product.

9 Claims, 2 Drawing Sheets

DISPENSER FOR A VISCOUS FLUID PRODUCT OPERATED BY MANUAL PRESSURE ON A BOTTOM END THEREOF, IN PARTICULAR FOR COSMETIC OR PHARMACEUTICAL USE

BACKGROUND OF THE INVENTION

1. Technical Field of the Invention

The invention relates to a dispenser for viscous fluid products such as creams' gels and the like, used generally as cosmetics or pharmaceuticals. The container comprises an external body into which a refill recipient is inserted. The refill has an open interior end into which a closing body is inserted. The closing body also functions as a piston which when manually pressed in an axial direction without any rotation pushes the product towards an aperture situated at a top end of the refill recipient. The user, obviously, is ready with his or her other hand to collect the thus dispensed fluid.

2. Prior Art

Such types of container are well known on the market, such as U.S. Pat. Nos. 4,984,718 and 5,000,600, both issued to the same applicant.

These prior art devices dispense products, in the form of cream or stick in a disposable manner, by rotating the upper portion of the container with respect to the lower portion. Such devices have an outer body, an inner body, and a seal provided for the containment of the product. The dispenser includes a rod which extends along the central axis, the rod having a lower wall which has an annular skirt which engages an annular projection on the bottom of the outer body. The inner body has a portion of a wall extending radially on elastic tabs which slide on a toothed configuration fixed with respect to the outer body.

The above-described prior art containers are provided with rotary-translating movement and are somewhat complex to realize. Furthermore, they are not simple to use, as one hand is needed to hold the outer body while the other twists the projecting portion of the inner body. Following rotation a prefixed dose of the product exits from the aperture and deposits on the closed top surface of the container, which can only then be collected by the user, as he or she now has a hand free.

Other containers on the market have a balance device on the top surface, such that by pressing on the surface the balance tips and creates internally to the container (thanks to the presence of a pump) a decompression which draws a dose of the cream and causes it to exit.

The principal aim of the present invention is to obviate the above-mentioned inconveniences by providing a dispenser of viscous fluid product having a dispensing action formed by manually pressing on the bottom surface of the dispenser, in particular for cosmetic or pharmaceutical use. The invention is also free of complex mechanisms and thus can be press-formed and assembled very simply, leading to a considerable reduction in production costs.

SUMMARY OF THE INVENTION

The invention provides a dispenser of viscous fluid product having a dispensing action constituted by manual pressing on the bottom surface of the dispenser, in particular for cosmetic and pharmaceutical use. The invention comprises: a tubular outer body having an open top end, and a bottom end which is partially closed but has a centrally located wide aperture. The outer body externally exhibits a first annular shoulder dividing the outer body into two portions, a top portion and a bottom portion. The top portion has a smaller thickness than that of the bottom portion. A tubular hollow recipient is removably housed in the outer body. The recipient has an external wall and a tubular internal wall closed by a wall affording an aperture for dispensing the fluid viscous product, and open at a bottom end. A tubular piston, housed internally at the bottom end of the tubular recipient, is provided with a lateral seal. The piston is movable in a direction along the inner tubular wall when manual pressure is applied thereon in proximity of the aperture in the outer tubular body at a portion centrally made in the piston and coaxial to the aperture. A lid and first and second means are provided for removably engaging the tubular recipient, the outer body and the lid.

One of the advantages obtained by the invention is that it is simple to use with respect to the prior art devices, as only one hand is needed to activate the dispenser. Further, the container dispenses a continuous quantity of product that depends on the pressure exerted without any need for the product to deposit on the top surface of the container, which deposits, in prior art solutions, often remain on the top surface and present an unhygienic and ugly sight.

A further advantage of the invention is that the hollow tubular recipient is used as a refill, with the following advantages:

- the only throwaway part of the entire dispenser is the inner tubular container, which can be made in a single material so that it is thereafter easily recyclable;
- a reduction in user cost is obtained, as only the refill container need be bought, and this need not be decorative or attractive to view, as must the outer container;
- there is no need to realize several different sizes of container, resulting in reduced production costs. To satisfy market requirements for different quantities, a container might be sold with two refills, for example. Accordingly at production level fewer press molds are needed,
- ease of refill insertion. It is sufficient to upturn the container to slide in the refill from the bottom and close it inside the outer cover using a special top;
- sealed erogation aperture. The detachable seal both guarantees good conservation of the product and provides a security to the buyer that only he or she has used the.e product;
- good consumer view. Thanks to the container transparency, of how much product is left and what condition it is in can be determined: and
- easy transformation of existing containers so that molds for outer containers presently on the market can be adapted, by opening an aperture at the bottom using machine tools.

BRIEF DESCRIPTION OF THE DRAWINGS

Further characteristics and advantages of the present invention will better emerge from the detailed description that follows, of an embodiment of the invention, illustrated in the form of a non-limiting example in the accompanying drawings, in which.

DESCRIPTION OF THE PREFERRED EMBODIMENTS

Figure 1:
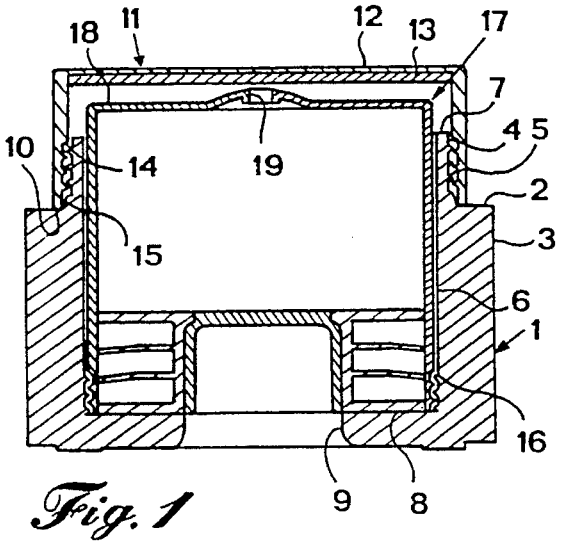
FIG. 1 is a longitudinal section of the dispenser container of the invention.

With reference to the drawings, FIG. 1 shows a dispenser container of fluid viscous products. Element 1 denotes a tubular outer body having an open top end 7 and a partially closed bottom end 8 exhibiting a large aperture 9. The outer body 1 is externally provided with a first annular abutment 2 dividing the outer body 1 into two portions, respectively a lower portion 3 and an upper portion 4, the latter exhibiting a second thread 5 and being thinner than the former. The outer body 1 further exhibits an internal tubular wall 6. A lower open end 10 of a lid 11 (which top end 12 is closed) screws on to the second thread 5 of the upper portion 4 and tightens down on the abutment 2. Internally of the top end 12, a supplementary body 13 made in a material compatible with the product contained in the container might be provided.

The internal surface of the lid 11 exhibits a second counter thread 14 which screwingly interacts with the second thread 5 on the outer body 1. FIG. 1 shows how the upper portion 4 is provided with an annular collar 15 on the abutment 2 which guarantees a hermetic seal between the outer body 1 and the lid 11.

Figure 2:
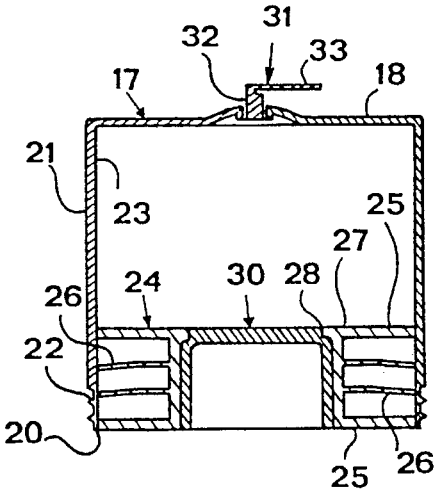
FIG. 2 is a longitudinal section of a part of the dispenser, in particular a tubular recipient with sealed aperture.

A hollow tubular recipient 17 containing product is housed internally of the wall 6 of the outer body 1, as can be seen in FIG. 2. The recipient 17 also functions as a refill when the product has been used up.

The recipient 17 has an external wall 21 and an internal wall 23 and is closed by a wall 18 affording a dispensing aperture 19 for the product. A first counter thread 16 is made on the internal wall 6 to engage the recipient 17 (which exhibits a first thread 22 coupling with said first counter thread 16) to the outer body 1.

A product p is introduced into the recipient 17 at the bottom end 20 through the bottom end 20, and once this operation has been carried out, a tubular piston 24 is inserted therein. Said tubular piston 24 exhibits lateral seals and is mobile along the internal wall 23 following manual pressure thereupon at a central portion 60 of the piston 24, situated in proximity of and coaxially to the aperture 9 of the outer body 1.

To guarantee a good hermetic peripheral seal, the tubular piston 24 is advantageously provided with two or more annular flanges 25, coaxial to the central portion 60 and perpendicularly incident to the internal wall 23, at least one of which annular flanges 25 is made in a flexible material to engage elastically on the internal wall 23 of the recipient 17.

Figure 3:
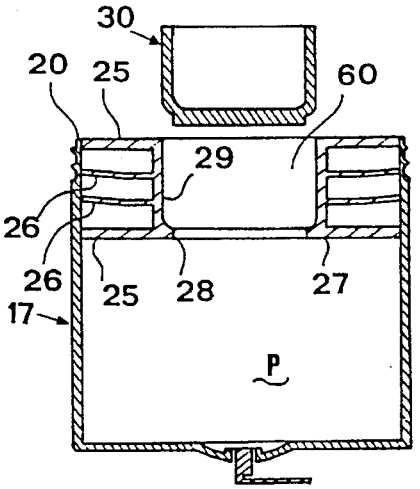
FIG. 3 shows a longitudinal section of the detail of FIG. 2, upturned for filling with product from below.

To simplify the product filling operation, the transversal surface 27 of the tubular piston 24 can be made in two parts. The tubular piston 24 exhibits a cylindrical central aperture 28 which is coaxial to the aperture 9 of the outer body 1. FIG. 3 shows how the recipient 17 is upturned so that the product p can be introduced from below, through the cylindrical opening 28 in the tubular piston 24, instead of through the aperture 9 of the bottom end 20.

After the filling operation, the cylindrical opening 28 is closed by a removable hollow tubular cap 30, which internally engages the central portion 60, and which is pressure-fixed by elastic friction along internal walls 29 of the central cylindrical opening 28.

The dispensing aperture 19 of the recipient 17 can be sealed before sale so that the user is certain that he or she is the first to open the dispenser, as well as to conserve the product well. Also, with the dispensing aperture 19 so sealed, during a filling operation the product will not escape. The dispenser can exhibit a sealing element 31 placed in the dispensing aperture 19. The sealing element 31 is made in one piece with the recipient 17 so that the two parts can be manufactured in the same operation and detached only when deliberately opened.

The sealing element 31 is constituted by a pivot 32 having an upper end provided with a thin transversal tongue 33 and a lower end connected by a thin breakable connecting surface 34 with the bottom end of the dispensing aperture 19. The connecting surface 34 must be very thin in order than a clean break is possible when the pivot 32 is pressed.

Figure 4:
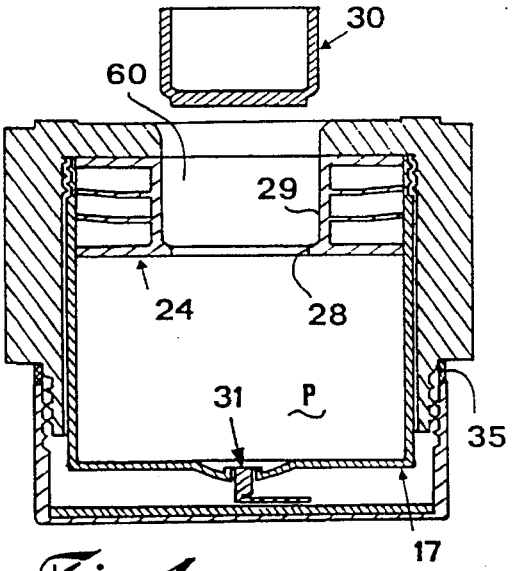
FIG. 4 is a longitudinal section of the dispenser with a sealing element ready for sale.

FIG. 4 shows the dispenser complete with full recipient 17 and ready for sale. This figure also shows the ease with which the product can be introduced through the transversal surface 27 of the two-part tubular piston 24.

FIG. 4 also shows the recipient 17 housed in the outer body 1, with the tubular cap 30 during the fixing phase, wherein the product p is easily introduced from below with the dispenser upturned. Sealing the dispenser with product simply involves having to close the cylindrical opening 28 of the tubular piston 24 with the tubular cap 30. Whereas, if the tubular piston 24 were not in two parts, one would have to fill the recipient 17, then insert the tubular piston 24 before coupling (by screwing) the full recipient 17 to the internal wall 6 of the outer body 1 and finally screwing on the lid 11.

In order to prevent the lining 13 of the top surface of the lid 11 coming into contact with the sealing element 31, the dispenser of FIG. 4 is provided with an annular spacer 35 placed between the abutment 2 of the outer body 1 and the open bottom end 10 of the lid 11.

Figure 5:
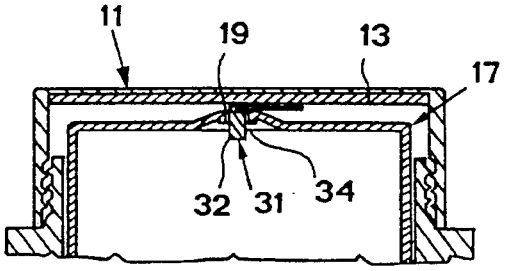
FIG. 5 is a detail of the detached sealing element.
Figure 6:
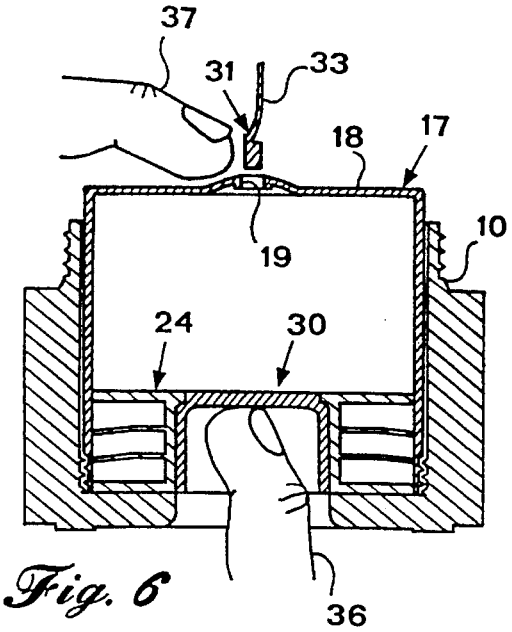
FIG. 6 shows how the pressure of a finger causes the product to exit while a finger of another hand collects the product.

Before use, the consumer has to detach the sealing element 31 by performing the following operations:

a) remove the lid 11 and the annular spacer 35;

b) screw on the lid 11 such that the top end thereof presses on the sealing element 31 and breaks the connecting surface 34 which connects it to the dispensing aperture 19, as illustrated in FIG. 5;

c) remove the lid 11 and the by-now detached sealing element 31 by gripping it by the tongue 33 as shown in FIG. 6.

If the connecting surface 34 is made very slim, pressure of a finger on the sealing element 31 may be enough to detach it from the dispensing aperture 19.

In FIG. 6 the dispenser is ready for use, so that by pressing with a finger 36 inserted into the central portion 60 of the tubular cap 30, the piston moves axially upwards without a rotating-translating movement and compresses the product p until it exits from the dispensing aperture 19 and can be collected by another finger 37 of the user's other hand. The product is dispensed continuously, not in prefixed doses as often is the case with dispensers already on the market, and in quantities decided by the user while pressing on the tubular piston 24.

After use the tubular piston 24 will come to rest in a higher position than before use, and when the product has been used up completely the tubular piston 24 will be in contact with the upper wall 18 of the recipient 17. As the piston 4 is able to move only upwards, there is no risk of its descending and trapping air inside the dispenser. The product is well conserved thanks to the hermetic seal, which in detail is constituted by the following:

a seal between the bottom open end 10 of the lid, and the annular collar 15 on the abutment 2 of the outer body a seal between the internal wall 23 of the recipient 17 and the flexible flanges 26 of the tubular piston 24, a seal between the internal walls 29 of the tubular piston 24 and the hollow tubular cap 30.

Given the absence of mechanisms governing the rising movement of the tubular piston 24, both the outer body 1 and the recipient 17 can be made of transparent material so that the amount of product remaining and its quality can be seen from the outside. This improvement confers a considerable advantage, since the consumer can now be sure the product in the dispenser has all been used up before buying a refill.

Figure 7:
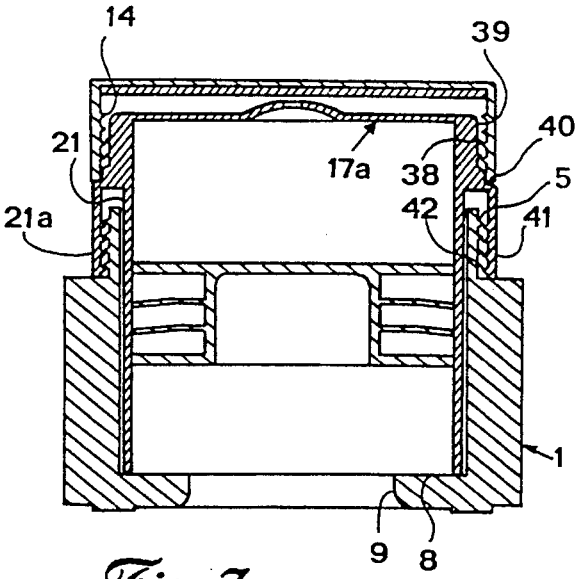
FIG. 7 shows a further embodiment of the invention of FIG. 1.

FIG. 1 shows the closed dispenser with the lid on, in a typical use configuration. FIG. 7 shows a dispenser with a screw engagement between a hollow recipient 17*a* and the outer body 1, and further between the lid 11 and the recipient 17*a*. This improvement has the aim of utilizing ready-made parts for traditional dispensers, for example the outer body 1 and the lid 11, which can be transformed with very few changes into dispensers suitable for the realization of the present invention, so that few new investments are necessary.

This is made possible by eliminating the screw engagement between the first counter thread 16 and the first thread 22 on the internal wall 6 of the outer body 1 as well as that between the external wall 21 of the recipient 17, and further modifying the external wall of the recipient 17, replacing it with (see FIG. 7) a fourth thread 38 on the recipient 17*a* which engages with a second counter thread 14 on the lid 11.

At the base of the fourth thread 38 a second annular abutment 40 is fashioned, which divides a second external wall 21*a* into two portions: a lower wall 41 internally provided with a third thread 42 interacting with a second counter thread 5 made on the outer body 1. The lower wall 41 projects externalwise of the outer body and is annularly concentric to and shorter than the second external wall 21*a*. A second portion comprising an upper wall 39 is provided with the fourth thread 38 which interacts with a second counter thread 14 provided on the lid 11.

Figure 8:
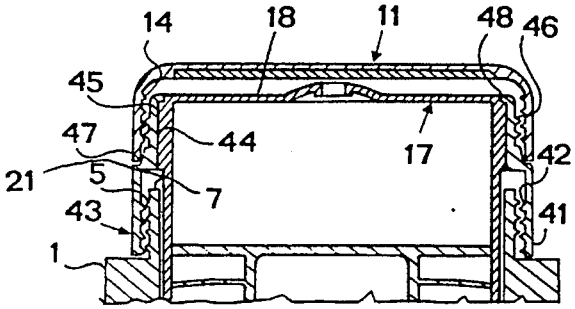
FIG. 8 shows a further embodiment of the invention of FIG. 7.

FIG. 8 shows the dispenser in a further embodiment. The recipient 17 in proximity of the upper wall 18 above the top end 7 of the outer body 1 is divided such as to create a separator body 43 having an internal wall 44 interfering with an external surface 45 of the recipient 17. The separator body 43 is further provided with an annular transversal intermediate wall 47 engaging with the externally-projecting lower wall 41, which intermediate wall 47 is concentric to and shorter than the external wall 21 of the recipient 17. The lower wall 41 is provided with a third thread 42. The separator body 43 further exhibits an upper wall provided with an external wall having a fourth thread 46 which screws against the second counter thread 14 of the lid 11, and further is provided with an internal wall 44 and an annular projection 48 on the upper end facing internalwise.

When the lid 11 is removed, the insertion and removal of the recipient 17 is performed by screwing the separator body 43 from the outer body 1 and sliding the recipient 17 in or out. Finally, the separator body 43 is screwed back on the outer body 1 such that the inwards-facing annular projection 48 axially and annularly constrains the recipient 17 to the separator body 43, which separator body 43 is screwed to the outer body 1.

The advantage of this last improvement is that it utilizes the tops and external bodies already used in commerce by various producers, even if there are small differences in volumes and internal diameters and height. Only the separator body 43 varies with respect to the small difference in traditional external bodies, while the larger recipient 17 is of a standard size for all types. The containers of FIGS. 1 to 8 are suitable for high-class products, as well as products which are not compatible with the material used in making the outer body 1, as they only come into contact with the recipient 17, which naturally is made in a material that is compatible with the product.

The material used for making the outer body 1 is very decorative, while that used for the recipient 17 can be very plain, as long as it is compatible with the product. Simpler and cheaper containers can be made by manufacturing the recipient 17 or 17*a* in a single piece' with the aperture 9 being at least as wide as the tubular wall. Naturally this type of container is ideal for cheaper products, where there is a lower sensibility of the product to the material of the container, and where aesthetic questions are less pressing.

Figure 9:
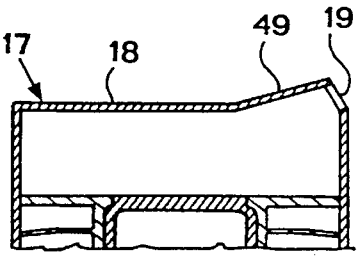
FIGS. 9 and 10 show variations of FIG. 2.
Figure 10:
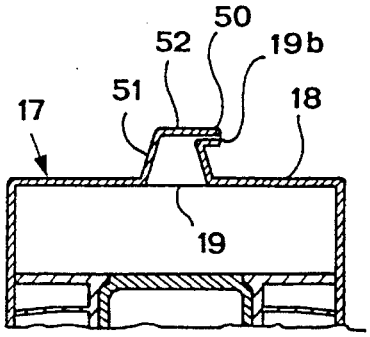

The containers of FIGS. 9 and 10 are composed of recipients 17 or 17*a* each having different dispensing apertures 19 on the upper wall 18. In FIG. 9 the dispensing aperture 19 is made in the peripheral edge of the upper wall 18 of the recipient 17, at the mouth of a slightly inclined pipe 49.

In FIG. 10 the dispensing aperture 19 is connected to an axial tubular element 51 with a closed upper wall 52, and is provided with a hollow lateral spout 50 affording a second dispensing aperture 19*b*.

What is claimed:

1. A dispenser of viscous fluid product having a dispensing action produced by a manual pressure on a bottom surface thereof, for cosmetic and pharmaceutical use, comprising, a tubular outer body having an open top end and a partially closed bottom end with a centrally located wide aperture, said outer body externally exhibits a first annular shoulder dividing the outer body into a top portion and a bottom portion, the top portion being thinner in breadth than the bottom portion;

a tubular hollow recipient removably housed in the outer body, exhibiting an external wall and a tubular internal surface and being superiorly closed by a top wall affording a dispensing aperture for dispensing the product, and being open at a bottom end;

a tubular piston, housed internally in the bottom end of the tubular recipient and provided with a lateral seal; said piston being mobile in a direction along the tubular internal surface when the manual pressure is applied thereupon in proximity of the aperture in the outer body at a central portion of the piston and coaxial to an axis of the aperture;

a lid;

first means for reciprocal and releasable engagement between the tubular recipient and the tubular outer body; and second means for reciprocal gripping between the tubular outer body and the lid.

2. The dispenser of viscous fluid product as in claim 1, wherein the first means for engagement is a first thread made on the recipient coupling with a first counter thread exhibited by the outer body, and in that the second means for gripping is a second thread made on the top portion of the outer body and coupling with a second counter thread exhibited by the lid.

3. The dispenser of viscous fluid product, as in claim 1, wherein the lateral seal of the piston comprises at least two annular flanges coaxial to the axis of the aperture and perpendicularly incident on the internal wall; at least one flange of the at least two annular flanges being made of a flexible material.

4. The dispenser of a viscous fluid product as in claim 1, wherein the dispensing aperture is connected to a tubular axial element having a closed upper end and being provided with a lateral spout on which a second dispensing aperture is fashioned.

5. The dispenser of a viscous fluid product as in claim 1, wherein the piston exhibits a cylindrical central aperture, coaxial to the axis of aperture of the outer body, removably closed by a hollow tubular cap, said tubular cap is fixable by elastic friction pressure along internal walls of the cylindrical central aperture.

6. The dispenser of viscous fluid product as in claim 1, wherein said dispensing aperture is provided with a sealing element comprising a pivot which at a top end thereof is provided with a thin transversal tongue and at a bottom end thereof is is solidly constrained to a breakable surface connected to the bottom end of said dispensing aperture; said sealing element being removable by exerting a pressure on said pivot until said breakable surface breaks and said sealing element is removed by means of said thin transversal tongue.

7. The dispenser of viscous fluid product as in claim 1, wherein a slightly inclined pipe is made on a peripheral edge of the top wall of the tubular recipient, which pipe exhibits said dispensing aperture.

8. A dispenser of viscous fluid product having a dispensing action produced by a manual pressure on a bottom surface thereof, for cosmetic and pharmaceutical use, comprising, a tubular outer body having an open top end and a partially closed bottom end with a centrally located wide aperture, said outer body externally exhibits a first annular shoulder dividing the outer body into a top portion and a bottom portion, the top portion being thinner in breadth than the bottom portion;

a tubular hollow recipient removably housed in the outer body, exhibiting a first external wall and a second external wall and being superiorly closed by a top wall affording a dispensing aperture for dispensing the product, and being open at a bottom end;

a tubular piston, housed internally in the bottom end of the tubular recipient and provided with a lateral seal; said piston being mobile in a direction along the first external wall when the manual pressure is applied thereupon in proximity of the aperture in the outer body at a central portion of the piston and coaxial to the aperture;

a lid;

wherein the recipient housed in the outer body has a second abutment which divides the second external wall into two portions which are unitary with the first external wall; said two portions being a lower wall and an upper wall; said lower wall being internally provided with a first thread coupling with a first counter thread made on the outer body, said lower wall projecting externalwise of said outer body and being annularly concentric to and shorter than the first external wall; said upper wall exhibiting a second thread coupling with a second counter thread exhibited by the lid.

9. A dispenser of viscous fluid product having a dispensing action produced by a manual pressure on a bottom surface thereof, for cosmetic and pharmaceutical use, comprising, a tubular outer body having an open top end and a partially closed bottom end with a centrally located wide aperture, said outer body externally exhibits a first annular shoulder dividing the outer body into a top portion and a bottom portion, the top portion being thinner in breadth than the bottom portion;

a tubular hollow recipient removably housed in the outer body, exhibiting an external wall and a tubular internal surface and being superiorly closed by a top wall affording a dispensing aperture for dispensing the product, and being open at a bottom end;

a tubular piston, housed internally in the bottom end of the tubular recipient and provided with a lateral seal; said piston being mobile in a direction along the internal tubular surface when the manual pressure is applied thereupon in proximity of the aperture in the outer body at a central portion of the piston and coaxial to the aperture;

a lid;

wherein a separator body is separately and removably engaged on the external wall of the recipient; the separator body having a second annular shoulder which divides the separator body into two portions; said two portions being a lower wall and an upper wall; said lower wall being internally provided with a first thread coupling with a first counter thread on said outer body; said upper wall exhibiting a second thread coupling with a second counter thread exhibited by the lid.

* * * * *